US009553393B2

(12) United States Patent
Kataoka et al.

(10) Patent No.: US 9,553,393 B2
(45) Date of Patent: Jan. 24, 2017

(54) LEVER-TYPE CONNECTOR

(71) Applicant: Sumitomo Wiring Systems, Ltd., Yokkaishi, Mie (JP)

(72) Inventors: Shigeto Kataoka, Mie (JP); Hideto Nakamura, Mie (JP); Tomonari Itou, Mie (JP); Takashi Matsuda, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/935,485

(22) Filed: Nov. 9, 2015

(65) Prior Publication Data

US 2016/0141789 A1 May 19, 2016

(30) Foreign Application Priority Data

Nov. 17, 2014 (JP) ..... 2014-232388

(51) Int. Cl.

| | |
|---|---|
| ***H01R 24/00*** | (2011.01) |
| ***H01R 13/502*** | (2006.01) |
| ***H01R 9/24*** | (2006.01) |
| ***H01R 13/629*** | (2006.01) |
| *H01R 13/631* | (2006.01) |

(52) U.S. Cl.

CPC ..... *H01R 13/502* (2013.01); *H01R 9/24* (2013.01); *H01R 13/62938* (2013.01); *H01R 13/631* (2013.01)

(58) Field of Classification Search

CPC ..... H01R 13/502; H01R 13/514
USPC ..... 439/660, 157, 626, 633
See application file for complete search history.

(56) References Cited

U.S. PATENT DOCUMENTS

| | | | | |
|---|---|---|---|---|
| 6,341,968 | B1 * | 1/2002 | Grant | H01R 13/62938 439/157 |
| 6,733,313 | B2 * | 5/2004 | Shinozaki | H01R 13/62955 439/157 |
| 6,764,324 | B2 * | 7/2004 | Shinozaki | H01R 13/62933 439/157 |
| 8,025,513 | B2 * | 9/2011 | Kobayashi | H01R 13/62966 439/157 |
| 2015/0093926 | A1 * | 4/2015 | Henmi | H01R 13/62933 439/157 |
| 2015/0325950 | A1 * | 11/2015 | Kamiya | H01R 13/502 439/157 |

(Continued)

FOREIGN PATENT DOCUMENTS

JP 2004-14142 1/2004

*Primary Examiner* — Tulsidas C Patel
*Assistant Examiner* — Peter G Leigh
(74) *Attorney, Agent, or Firm* — Gerald E. Hespos; Michael J. Porco; Matthew T. Hespos

(57) ABSTRACT

A lever-type connector has tubular fitting (13) with an outer regulating wall (20) on a side opposite to a lever accommodating portion (16) across a terminal accommodating portion (10). A receptacle (41) includes an inner regulating wall (44) arranged along the outer regulating wall (20) and a facing wall (45) arranged along the lever accommodating portion (16) and facing the inner regulating wall (44). Regulating protrusions (48) are formed on an inner surface of the inner regulating wall (44). Posture inclination between a female housing (F) and a male housing (M) is regulated by contact of a tip outer edge (44E) of the inner regulating wall (44) and an inner surface of the outer regulating wall (20) and by the contact of a tip outer edge (10E) of the terminal accommodating portion (10) and the regulating protrusions (48).

5 Claims, 9 Drawing Sheets

(56) References Cited

U.S. PATENT DOCUMENTS

2016/0141799 A1* 5/2016 Kataoka ..... H01R 13/62938
439/372

* cited by examiner

LEVER-TYPE CONNECTOR

BACKGROUND

1. Field of the Invention

The invention relates to a lever-type connector.

2. Description of the Related Art

Japanese Unexamined Patent Publication No. 2004-014142 discloses a lever-type connector that has a male housing with a receptacle and a female housing with a terminal accommodating portion to be fit into the receptacle and connected by rotating a lever on the female housing. The lever is a single plate arranged along an outer wall of the terminal accommodating portion. Further, a clearance for making a connecting operation smooth is secured between the peripheral surfaces of the housings in consideration of dimensional tolerances. Thus, in the process of connecting the two housings, the postures of the two housings may incline with an engaged part of a cam groove of the lever and a cam follower of the receptacle as a supporting point. Sliding resistance between a terminal fitting of the male housing and a terminal fitting of the female housing increases if the inclination of the two housings increases, and, as a result, connection resistance increases.

The invention was completed based on the above situation and aims to suppress inclination of a male housing and a female housing in a connecting process of a lever-type connector that uses a single plate-shaped lever.

SUMMARY

The invention is directed to a lever-type connector with female and male housings. The female housing has a block-like terminal accommodating portion and a substantially rectangular tubular fitting surrounds the terminal accommodating portion. A lever is accommodated rotatably in a accommodating portion of the tubular fitting and is substantially in the form of a single plate with a cam groove. The male housing has a substantially rectangular tubular receptacle, and a cam follower is formed on an outer surface of the receptacle. The female and male housings are set in an initial state with the receptacle accommodated shallowly into a connection space between the terminal accommodating portion and the tubular fitting and with the cam follower inserted into an entrance of the cam groove. The lever is rotated from the initial state. As a result, the cam follower and the cam groove generate a cam action that connects the female and male housings. An outer regulating wall of the tubular fitting is arranged on a side opposite to the accommodating portion across the terminal accommodating portion. An inner regulating wall of the receptacle is arranged along the outer regulating wall, and a facing wall of the receptacle is arranged along the accommodating portion and faces the regulating wall. A regulating protrusion is formed on an inner surface of the regulating wall. A tip outer edge of the inner regulating wall contacts an inner surface of the outer regulating wall to regulate a posture inclination between the female and male housings and by the contact of a tip outer edge of the terminal accommodating portion and the regulating protrusion in a state where an outer surface of the facing wall is not in contact with the accommodating portion in the process of rotating the lever.

A clearance is secured between the inner peripheral surface of the tubular fitting and the outer peripheral surface of the receptacle to make a connecting operation of the housings smooth, but posture inclination may occur between the two housings due to this clearance. The posture inclination between the two housings is maximized when the accommodating portion of the tubular fitting and the facing wall of the receptacle are in contact and the outer regulating wall of the tubular fitting and the inner regulating wall of the receptacle are in contact. However, the regulating protrusion is formed on the inner surface of the regulating wall and the tip outer edge of the terminal accommodating portion and the regulating protrusion are brought into contact in the state where the outer surface of the facing wall is not in contact with the accommodating portion. Accordingly, the posture inclination between the two housings can be suppressed.

The regulating protrusion may be a rib extending along a connecting direction of the female and male housings. Thus, frictional resistance due to relative sliding movements of the terminal accommodating portion and the regulating protrusion can be small.

The tip outer edge of the terminal accommodating portion may contact the regulating protrusion before contact resistance between a female terminal fitting in the female housing and a male terminal fitting in the male housing is maximized when connecting the two housings.

The contact resistance between the female and male terminal fittings increases as an angle of inclination between the two housings increases. However, the posture inclination of the two housings is suppressed before the contact resistance between the female terminal fitting and the male terminal fitting is maximized. In this way, an increase in the contact resistance between the two terminal fittings can be suppressed.

Plural types of male terminal fittings may be provided in the male housing and may have tabs with projecting ends at differing positions toward the female housing. The tabs that project farthest may be in contact with the female terminal fittings in the female housing may be provided in the male housing, and the tabs that project shorter distances toward the female housing may not be in contact with the female terminal fittings in the female housing when the tip outer edge of the terminal accommodating portion contacts the regulating protrusion. Thus, a maximum value of the contact resistance between the terminal fittings can be reduced.

The lever-type connector may include a ring-shaped seal for sealing between an outer periphery of the terminal accommodating portion and an inner periphery of the receptacle. The regulating protrusion may contact an outer peripheral surface of the terminal accommodating portion with the female and male housings connected to exhibit a positioning function for positioning the terminal accommodating portion and the receptacle in a radial direction. This configuration is simple as compared with the case where a dedicated positioning means is provided separately from the regulating protrusion since the regulating protrusion.

DETAILED DESCRIPTION

A lever-type connector according to an embodiment of the invention is configured so that two female housings F and one male housing M are connected by rotating levers 30 provided on the respective female housings F. The two female housings F are bilaterally symmetrical. Thus, one female housing F is described, and the other female housing F is not described. In the following description, a vertical direction is defined so that upper and lower sides shown in FIGS. 1 to 7 are upper and lower sides.

Figure 1:
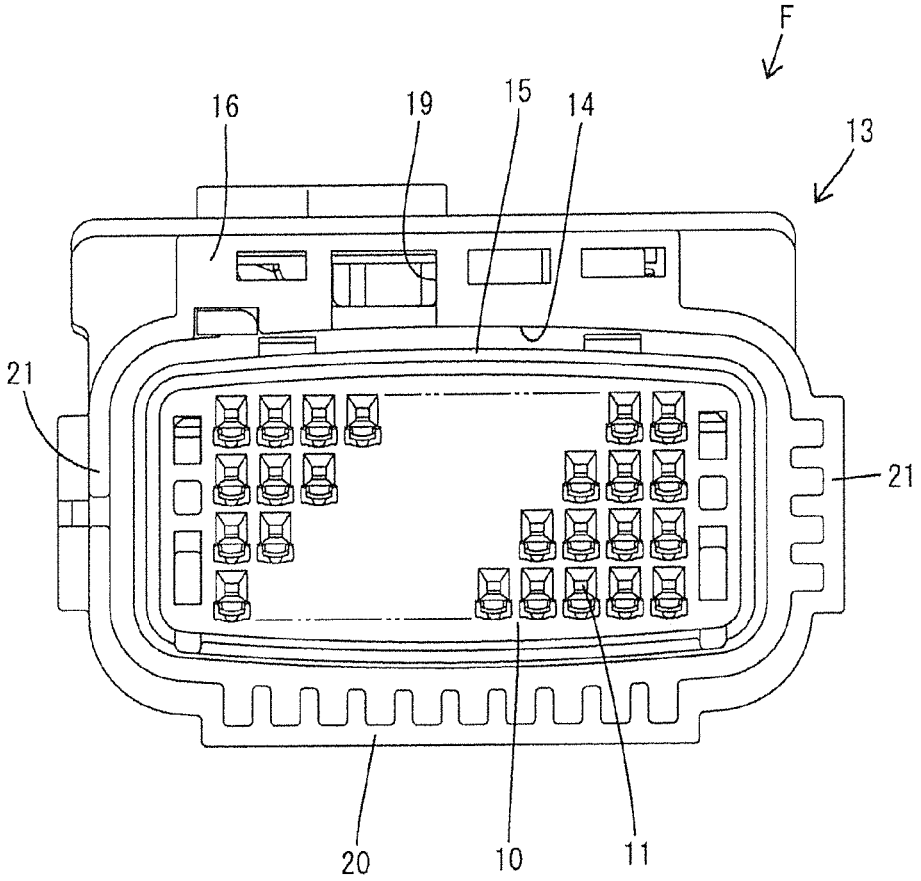
FIG. 1 is a front view of a female housing of one embodiment.
Figure 2:
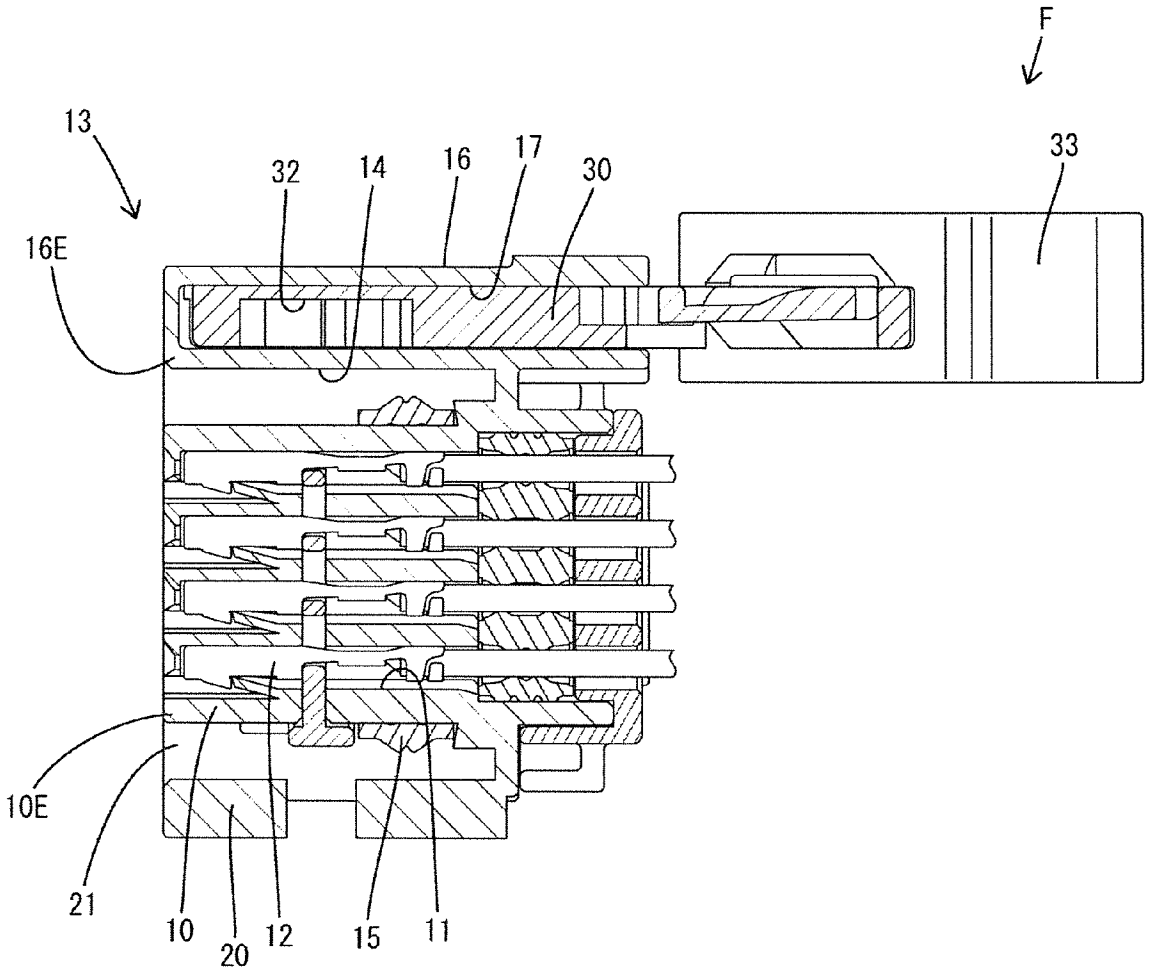
FIG. 2 is a side view in section of the female housing.

As shown in FIGS. 1 and 2, the female housing F is formed unitarily to include a block-like terminal accommodating portion 10 and a substantially rectangular tubular fitting 13 surrounding the terminal accommodating portion 10. The front ends of the terminal accommodating portion 10 and the tubular fitting 13 are at the same position in a front-back direction that is parallel to a connecting direction of the two housings F, M. Terminal accommodating chambers 11 are aligned in vertical and lateral directions in the terminal accommodating portion 10, and female terminal fittings 12 are inserted respectively into the terminal accommodating chambers 11 from behind. The front ends of all the female terminal fittings 12 are aligned at the same position in the front-back direction.

The terminal accommodating portion 10 and the tubular fitting 13 are connected near rear end parts (right end parts in FIGS. 2 and 5 to 7) thereof. A forwardly open substantially rectangular tubular connection space 14 is formed between the outer periphery of the terminal accommodating portion 10 and the inner periphery of the tubular fitting 13. A ring-shaped seal 15 is mounted in a rear end part of the connection space 14 and closely contacts the outer periphery of the terminal accommodating portion 10.

Figure 8:
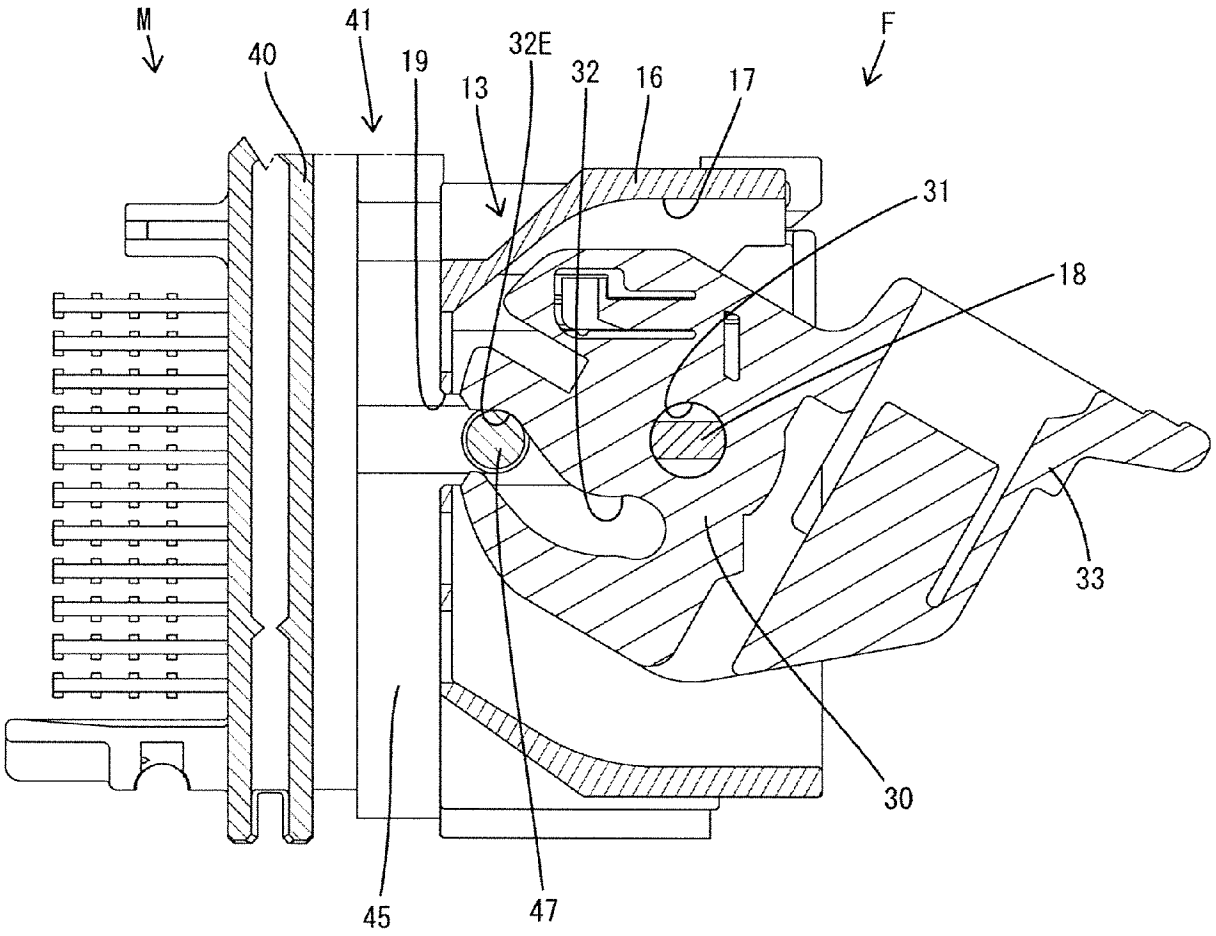
FIG. 8 is a plan view in section showing a state where the lever is at the initial position.
Figure 9:
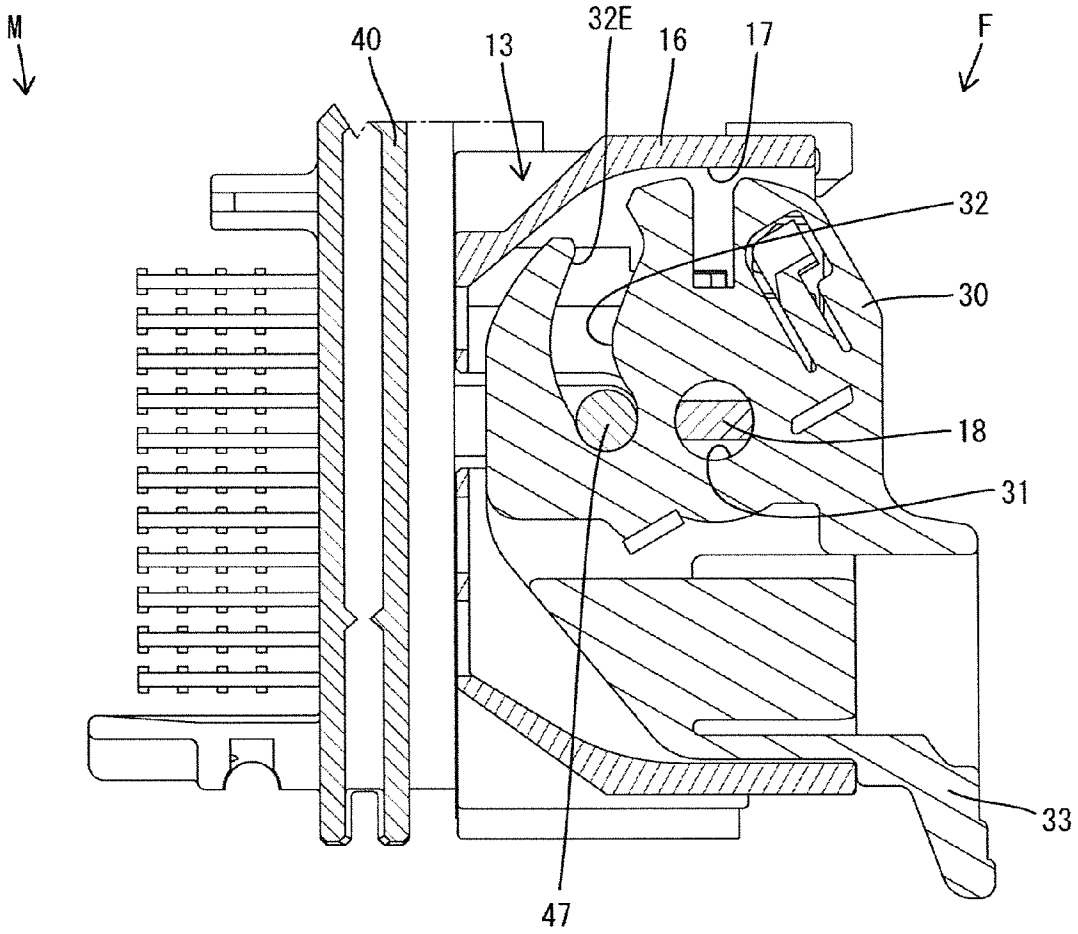
FIG. 9 is a plan view in section showing the state where the two housings are connected.

As shown in FIGS. 1 and 2, the tubular fitting 13 is a substantially rectangular tube with an lever accommodating portion 16, an outer regulating wall 20, and left and right coupling walls 21. A rearwardly open accommodation space 17 is formed in the female housing F inward of the lever accommodating portion 16. As shown in FIGS. 8 and 9, a supporting shaft 18 for rotatably supporting the lever 30 is provided in the accommodation space 17 and has an axis aligned vertically and in direction perpendicular to a connecting direction of two housings. Further, as shown in FIGS. 1 and 8, an insertion opening 19 is open on the front wall of the lever accommodating portion 16 for allowing a cam follower 47 to be inserted into the accommodation space 17. The outer regulating wall 20 faces the lever accommodating portion 16 across the terminal accommodating portion 10. Left and right coupling walls 21 connect left and right ends of the lever accommodating portion 16 and left and right ends of the lower regulating wall 20.

The lever 30 is a single substantially horizontal single plate. As shown in FIGS. 8 and 9, the lever 30 has a bearing hole 31, a cam groove 32 and an operating portion 33. The bearing hole 31 penetrates through the lever 30 in the vertical plate thickness direction. An entrance 32E of the cam groove 32 is open on the outer peripheral edge of the lever 30 and the cam groove 32 forms a path oblique to a circumference centered on the bearing hole 31. The operating portion 31 is formed by causing the outer peripheral edge of the lever 30 to project out.

An area of the lever 30 including the bearing hole 31 and the cam groove 32 is accommodated in the accommodation space 17 with the bearing hole 31 engaged on the supporting shaft 18. The lever 30 is pivotable between an initial position (see FIG. 8) and a connection position (see FIG. 9) about the supporting shaft 18 and the bearing hole 31. The operating portion 33 projects out from the accommodation space 17 and is gripped to pivot the lever 30. The entrance 32E of the cam groove 32 is open forward toward the male housing M when the lever 30 is at the initial position.

Figure 3:
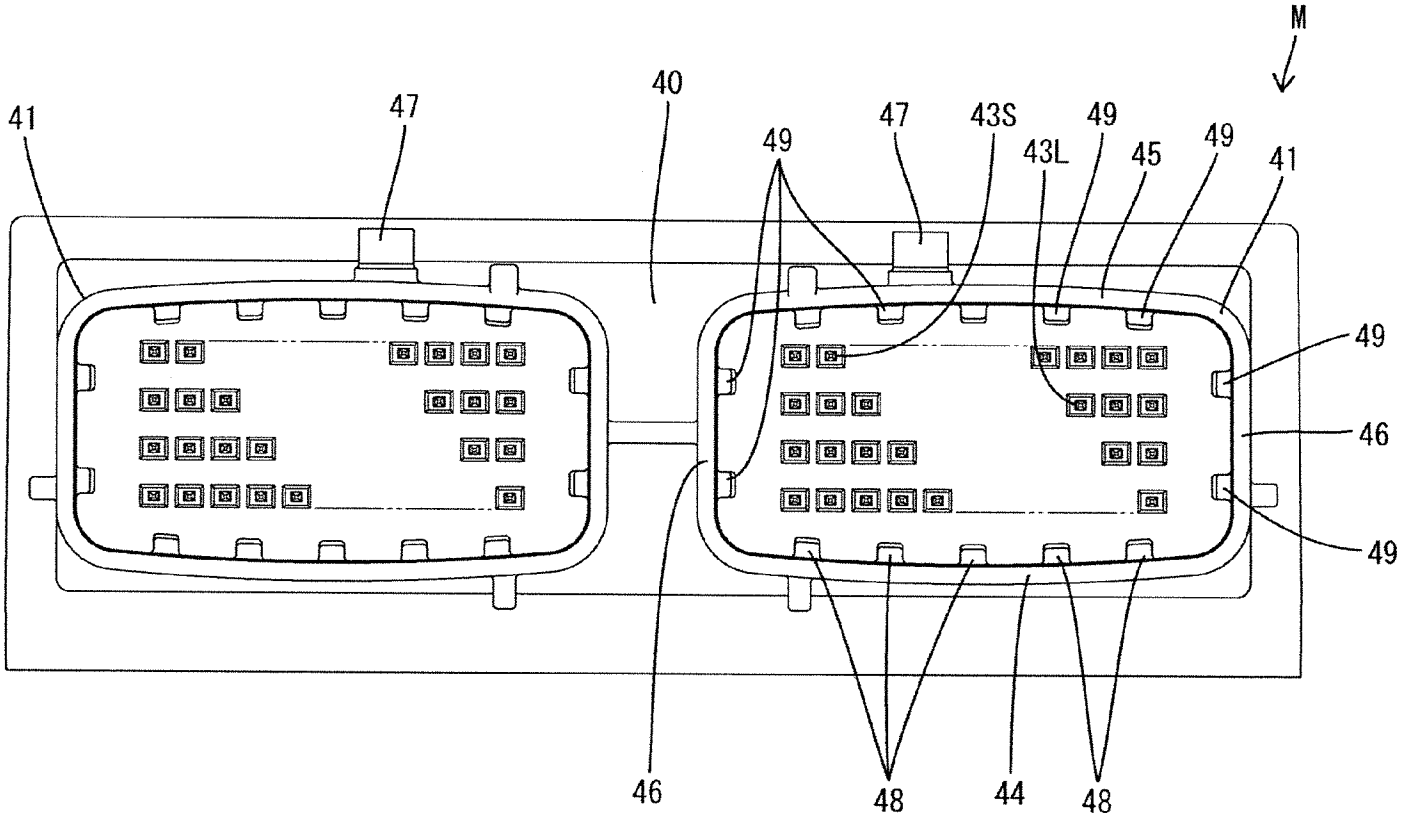
FIG. 3 is a front view of a male housing.

As shown in FIG. 3, the male housing M is formed unitarily to include one terminal holding portion 40 and two bilaterally symmetrical receptacles 41. The terminal holding portion 40 faces the front end surface of the terminal accommodating portion 10 with the two housings F, M connected. Each receptacle 41 is a substantially rectangular tube and extends forward (right in FIGS. 4 to 7) from the outer peripheral edge of the terminal holding portion 40. Male terminal fittings 42L, 42S are held in the terminal holding portion 40 while penetrating in the front-back direction, such as by being press-fit.

The male terminal fittings 42L, 42S are long narrow bars and are bent substantially at a right angle when viewed laterally. Downward extending base end parts of the male terminal fittings 42L, 42S are connected to a circuit board (not shown). Tips of the male terminal fittings 42L, 42S define tabs 43L, 43S that are cantilevered forward (i.e. toward the female housing F) from the terminal holding portion 40 and are surrounded by the receptacle 41. The male terminal fittings 42L are relatively long and the male terminal fittings 42S are relatively short. The projecting front ends of the tabs 43L of the long male terminal fittings 42L are more forward than the projecting front ends of the tabs 43S of the short male terminal fittings 42S. Thus, timings at which the tabs 43L, 43S and the female terminal fittings 12 start to contact differ in the process of connecting the two housings F, M.

Figure 4:
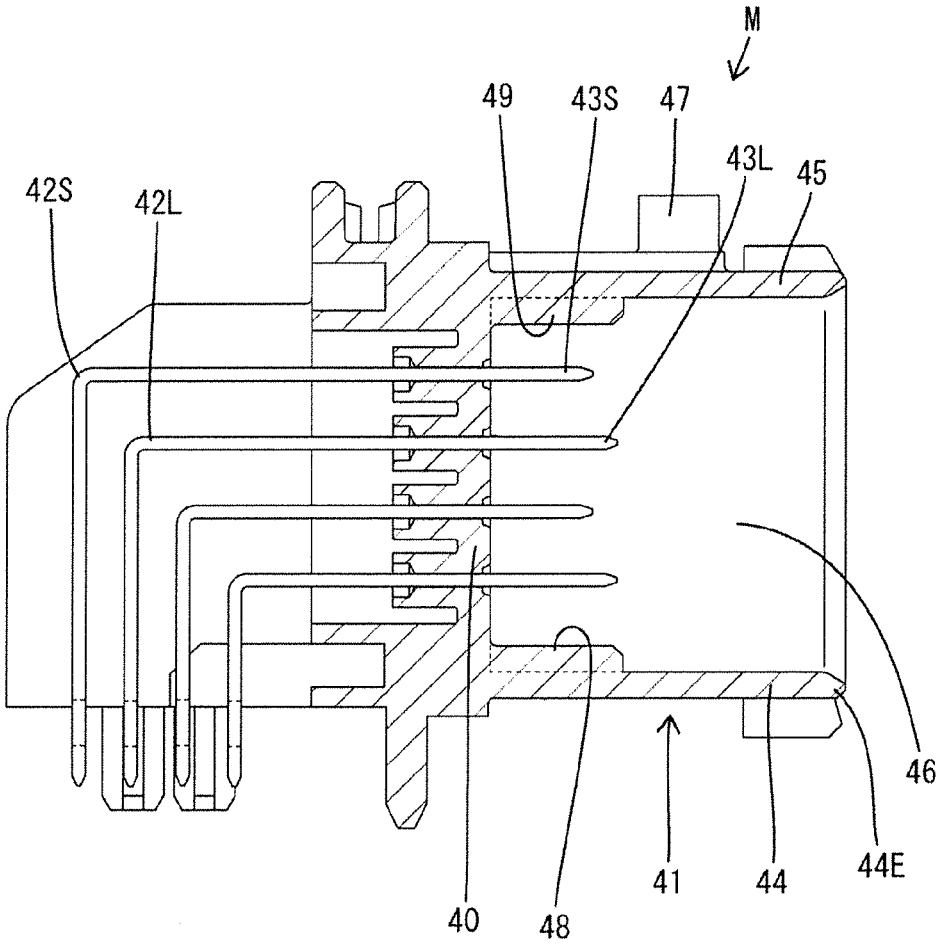
FIG. 4 is a side view in section of the male housing.

As shown in FIG. 3, the receptacle 41 is a substantially rectangular tube formed by an inner regulating wall 44 at a lower position, a facing wall 45 at an upper position and left and right side walls 46. The facing wall 45 faces the inner regulating wall 44 in the vertical direction. As shown in FIGS. 3 and 4, the cylindrical cam follower 47 is aligned vertically on an outer surface of the facing wall 45. To connect the two housings F, M, the lever 30 is first set to wait at the initial position and the receptacle 41 is fit shallowly into the connection space 14. In this way, as shown in FIG. 8, the cam follower 47 is inserted into the entrance 32E of the cam groove 32 and the two housings F, M are set in an initial state.

Rotation of the lever 30 from this initial state causes a cam action between the cam groove 32 and the cam follower 47. The cam action pulls the housings F, M toward each other so that a connecting operation of the two housings F, M proceeds. During this time, insertion of the receptacle 41 into the connection space 14 increases and the tabs 43L, 43S of the male terminal fittings 42L, 42S are inserted into the terminal accommodating portion 10 and start to contact the female terminal fittings 12. The connecting operation of the two housings F, M is completed when the lever 30 reaches the connection position and the female terminal fittings 12 and the male terminal fittings 42L, 42S are connected electrically conductively.

The inner regulating wall 44 is arranged along the outer regulating wall 20 both in the process of inserting the receptacle 41 into the connection space 14 as the two housings F, M are being connected and also in a state where the insertion of the receptacle 41 is completed and the two housings F, M are connected. Additionally, a lower surface of the inner regulating wall 44 and an upper surface of the outer regulating wall 20 face each other. Likewise, in a state where the receptacle 41 is inserted in the connection space 14 and in a state where the insertion is completed, an upper surface of the facing wall 45 is arranged along and faces a lower surface of the lever accommodating portion 16.

A clearance for making the connecting operation of the two housings F, M smooth is provided between the inner peripheral surface of the tubular fitting 13 and the outer peripheral surface of the receptacle 41. Further, in the process of connecting the two housings F, M, an engaged part of the cam groove 32 and the cam follower 47 precedes in upper surface parts of the two housings F, M (tubular fitting 13 and receptacle 41) and lower parts of the two housings F, M follow. Thus, the postures of the two housings F, M are going to incline during the connecting process so that the front end surfaces of the respective housings F, M face obliquely down with the contact part of the cam groove 32 and the cam follower 47 as a supporting point.

Posture inclination between the two housings F, M due to the clearance is maximized when the front edge of the inner surface (tip edge of the inner surface) of the lever accommodating portion 16 and the outer surface of the facing wall 45 are in contact and when the inner surface of the outer regulating wall 20 and the front end edge of the outer surface (tip edge of the outer surface) of the inner regulating wall 44 are in contact. Sliding resistance between the male terminal fittings 42L, 42S and the female terminal fittings 12 increases when the inclination of the two housings F, M increases. As a result, connection resistance between the two housings F, M increases. Accordingly, the inner regulating wall 44 is formed with regulating protrusions 48 for suppressing the posture inclination of the two housings F, M and thereby reducing connection resistance.

The regulating protrusions 48 are arranged side by side at predetermined intervals in a width direction (direction intersecting both the connecting direction of the two housings F, M and a projecting direction of the regulating protrusions 48). Further, each regulating protrusion 48 is in the form of a rib projecting up from the inner surface of the outer regulating wall 44 and extending in the front-back direction. The projecting direction of the regulating protrusion 48 is opposite to a direction facing the outer regulating wall 20, i.e. a direction toward the outer surface (lower surface) of the terminal accommodating portion 10. A formation area of the regulating protrusion 48 in the front-back direction is from a position behind the front end of the outer regulating wall 44 to the rear end of the outer regulating wall 44 and is common for each regulating protrusion 48.

Figure 5:
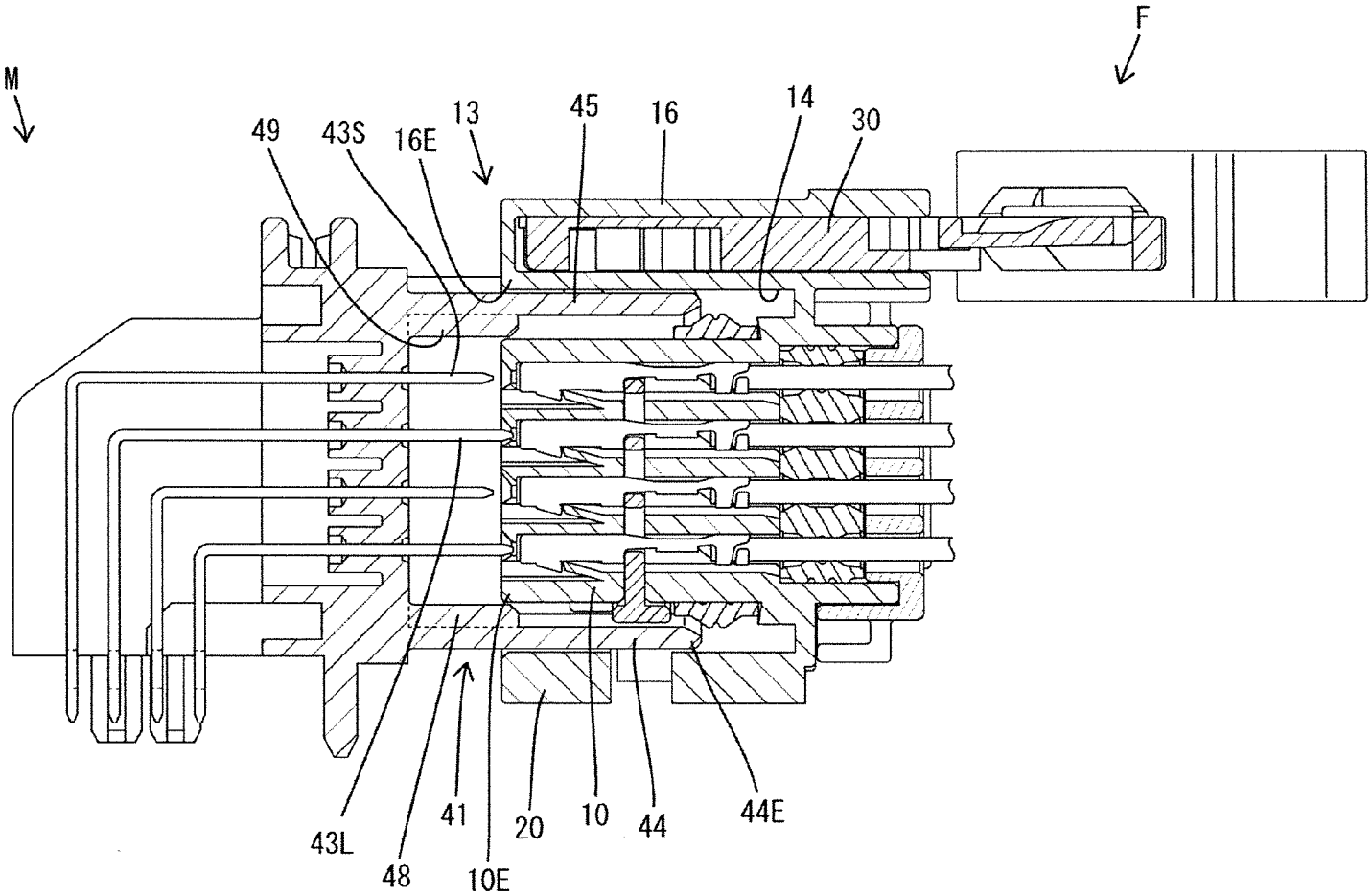
FIG. 5 is a side view in section showing a state where the connection of the two housings is started with a lever located at an initial position.

A tip outer edge 10E of the terminal accommodating portion 10 is located close to the front ends of the regulating protrusions 48 when the two housings F, M are in the initial state shown in FIG. 5. The lever 30 then is rotated from this state, and the postures of the two housings F, M incline so that the front end surfaces thereof face obliquely down. Thus, a tip outer edge 44E of the outer regulating wall 44 contacts the inner surface of the inner regulating wall 20 and the tip outer edge 10E of the terminal accommodating portion 10 contacts the regulating protrusions 48 as shown in FIG. 6 immediately after the start of the rotation.

Figure 6:
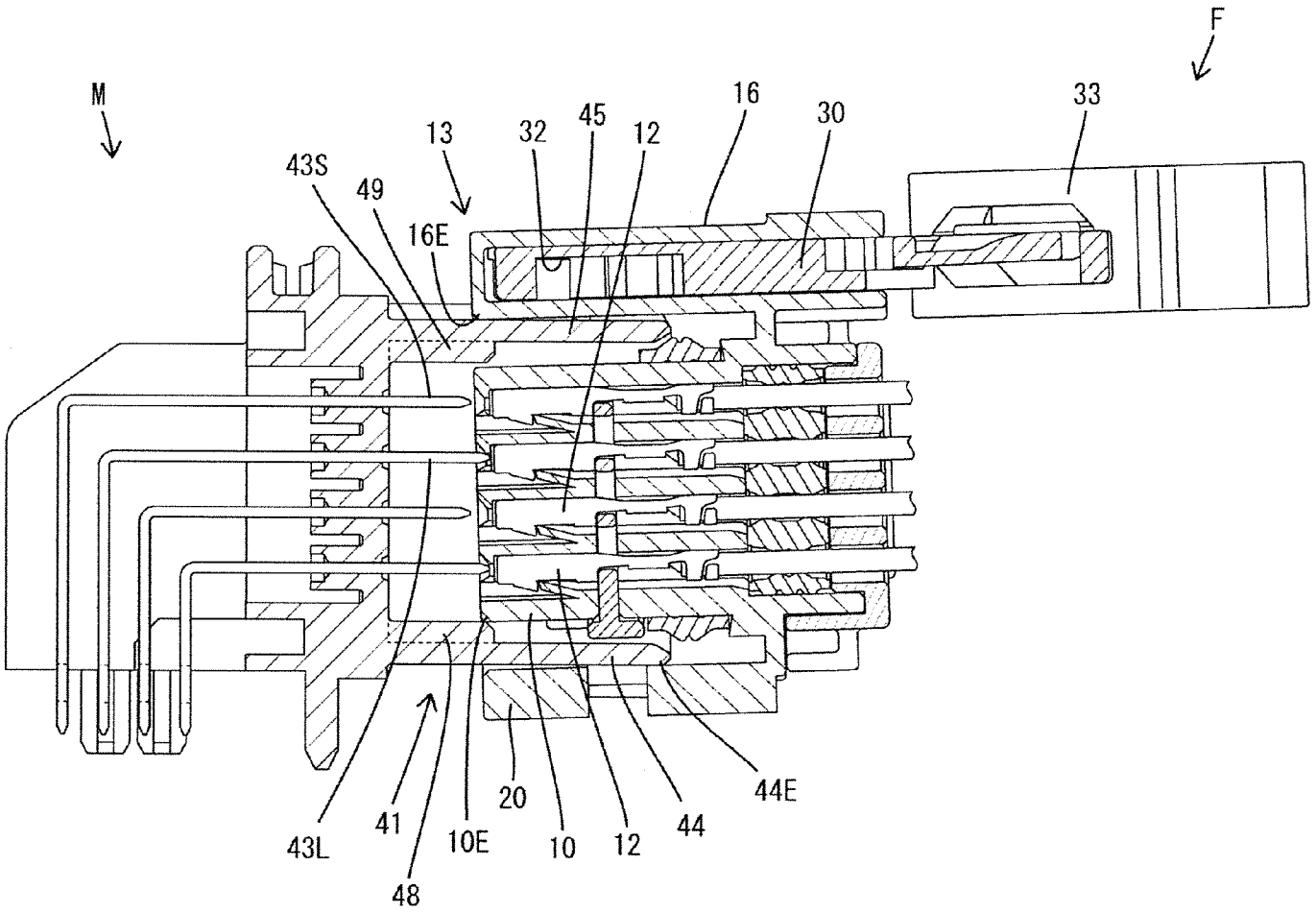
FIG. 6 is a side view in section showing a state where the rotation of the lever is started and the posture inclination of the two housings is regulated.
Figure 7:
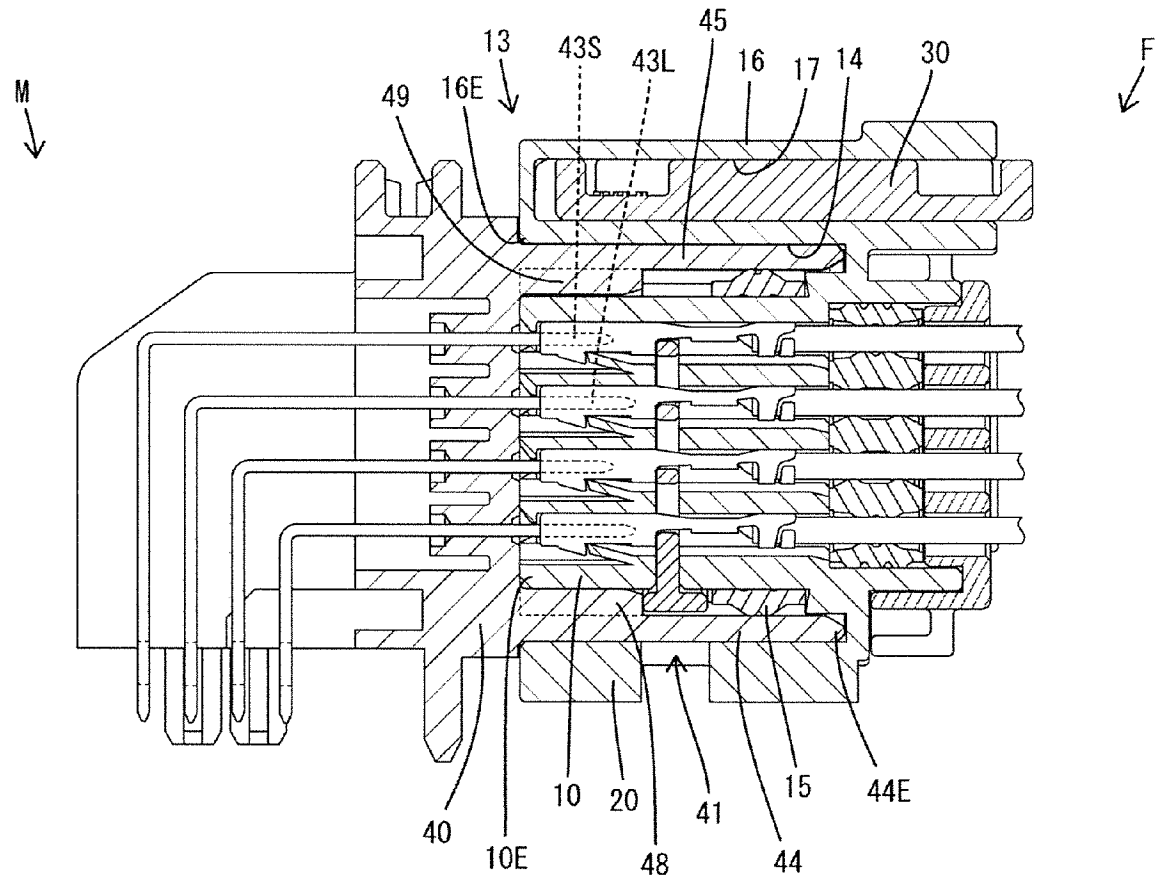
FIG. 7 is a side view in section showing a state where the two housings are connected.

At this time, the outer (upper) surface of the facing wall 45 is not in contact with a tip inner edge 16E of the accommodating portion 16 (not in contact although it looks to be in contact at a glance in FIG. 6) and a clearance due to dimensional tolerances remains between the facing wall 45 and the lever accommodating portion 16. That is, the inclination of the two housings F, M is suppressed to be smaller than in a state where the outer surface of the facing wall 45 and the tip inner edge 16E of the lever accommodating portion 16 are in contact. Further, at this time, not all of the tabs 43L, 43S are in contact with the female terminal fittings 12. That is, the long tabs 43L are at positions proximately facing the female terminal fittings 12. However, the short tabs 43S are separated significant distances from the female terminal fittings 12.

The lever 30 is rotated from this state and the connection of the two housings F, M proceeds. Thus, the tip outer edge 44E of the outer regulating wall 44 slides in contact with the inner surface of the outer regulating portion 20 and the tip outer edge 10E of the terminal accommodating portion 10 slides in contact with the upper surfaces of the regulating protrusions 48. During this time, the female housing F is displaced relatively down with respect to the male housing M since a slide contact area of the inner regulating wall 44 on the upper surface of the outer regulating 20 is elevated gradually as the connection of the two housings F, M proceeds. On the other hand, a slide contact position of the terminal accommodating portion 10 with the regulating protrusions 48 remains unchanged at the tip outer edge 10E. Thus, as the connection of the two housings F, M proceeds, the posture of the female housing F changes in a direction to make the inclination with respect to the male housing M smaller. When the two housings F, M are connected, the posture inclination between the two housings F, M is minimized.

Further, in the process of connecting the two housings F, M, the long tabs 43L start to contact the female terminal fittings 12 after the tip outer edge 10E of the terminal accommodating portion 10 contacts the regulating protrusions 48 and, subsequently, the short tabs 43S start to contact the female terminal fittings 12. Thereafter, contact resistance between the long tabs 43L and the female terminal fittings 12 is maximized and, subsequently, contact resistance between the short tabs 43S and the female terminal fittings 12 is maximized. During this time, the posture inclination of the two housings F, M is suppressed by the regulating protrusions 48, as described above, the contact resistance between the tabs 43L, 43S (male terminal fittings 42L, 42S) and the female terminal fittings 12 also is suppressed.

With the two housings F, M connected, the seal 15 mounted around the terminal accommodating portion 10 is held resiliently in close contact with the outer peripheral surface of the terminal accommodating portion 10 and the inner peripheral surface of the receptacle 41. At this time, if the amount of resilient deflection of the seal 15 is uniform over the entire circumference, sealing by the seal 15 is stable over the entire circumference. Accordingly, positioning protrusions 49 are formed on the inner (lower) surface of the facing wall 45 of the receptacle 41 and the inner surfaces of the left and right side walls 46.

The positioning protrusions 49 are ribs projecting in the front-back direction similarly to the regulating protrusions 48. A formation area of the positioning protrusions 49 in the front-back direction is the same range as that of the regulating protrusions 48. With the housings F, M connected, the positioning protrusions 49 of the facing wall 45 and the regulating protrusions 48 of the inner regulating wall 44 contact and vertically sandwich the front end part of the terminal accommodating portion 10. Likewise, with the two housings F, M connected, the positioning protrusions 49 of the left and right side walls 46 contact and laterally sandwich the front part of the terminal accommodating portion 10. By these contact actions, the terminal accommodating portion 10 (female housing F) and the receptacle 41 (male housing M) are positioned in vertical and lateral directions perpendicular to the connecting direction. Since the amount of resilient deflection of the seal 15 is uniform over the entire circumference in this way, stable sealing is exhibited over the entire circumference.

As described above, the lever-type connector includes the female housing F with the block-like terminal accommodating portion 10 and the substantially rectangular tubular fitting 13 surrounding the terminal accommodating portion 10. The lever 30 is a single plate formed with the cam groove 32 and is accommodated rotatably in the accommodating portion 16 of the tubular fitting 13. The male housing M includes the substantially rectangular tubular receptacle 41 and the cam follower 47 is formed on the outer surface of the receptacle 41. The two housings F, M are set in the initial state by accommodating the receptacle 41 shallowly into the connection space 14 between the terminal accommodating portion 10 and the tubular fitting 13 so that the cam follower 47 is inserted into the entrance 32E of the cam groove 32. The lever 30 then is rotated from the initial state so that the two housings F, M are connected by the cam action between the cam groove 32 and the cam follower 47.

The clearance exists between the inner peripheral surface of the tubular fitting 13 and the outer peripheral surface of the receptacle 41 to make the connecting operation of the two housings F, M smooth. However, posture inclination may occur between the two housings F, M due to this clearance. Posture inclination between the two housings F, M due to this clearance is maximized when the lever accommodating portion 16 and the facing wall 45 are in contact and the outer regulating wall 20 and the inner regulating wall 44 are in contact. Accordingly, the connector includes the outer regulating wall 20 on the side opposite the lever accommodating portion 16 across the terminal accommodating portion 10. The inner regulating wall 44 of the receptacle 41 is arranged along the outer regulating wall 20 and the facing wall 45 is arranged along the wall-like accommodating portion 16 that faces the regulating wall 44 of the receptacle 41. Further, the regulating protrusions 48 are formed on the inner surface of the regulating wall 44.

In the process of rotating the lever 30, the tip outer edge 44E of the inner regulating wall 44 and the inner surface of the outer regulating wall 20 are brought into contact and the tip outer edge 10E of the terminal accommodating portion 10 and the regulating protrusions 48 are brought into contact in the state where the outer surface of the facing wall 45 is not in contact with the lever accommodating portion 16 (although it looks to be in contact at a glance in FIG. 6). These contacts suppress or regulate the posture inclination between the two housings F, M.

Contact resistance between the female terminal fittings 12 and the male terminal fittings 42L, 42S increases as an angle of inclination between the two housings F, M increases. Accordingly, the tip outer edge 10E of the terminal accommodating portion 10 is brought into contact with the regulating protrusions 48 before the contact resistance between the female terminal fittings 12 in the female housing F and the male terminal fittings 42L, 42S in the male housing M is maximized in the process of connecting the housings F, M. According to this configuration, the posture inclination of the two housings F, M is suppressed before the contact resistance between the female terminal fittings 12 and the male terminal fittings 42L, 42S is maximized. Thus, an increase in the contact resistance between the terminal fittings 12 and 42L, 42S can be suppressed.

The male housing M includes male terminal fittings 42L, 42S differing in the positions of the projecting ends of the tabs 43L, 43S toward the female housing F. Accordingly, the long tabs 43L have projecting ends close to the female terminal fittings 12 of the female housing F when the tip outer edge 10E of the terminal accommodating portion 10 contacts the regulating protrusions 48. At this time, the short tabs 43S have projecting ends are more distant from the female housing F than the long tabs 43L and are not in contact with the female terminal fittings 12. According to this configuration, a maximum value of the contact resistance between the female terminal fittings 12 and the male terminal fittings 42L, 42S can be reduced.

The regulating protrusions 48 are ribs extending along the connecting direction of the two housings F, M. Thus, frictional resistance due to relative sliding movements of the terminal accommodating portion 10 and the regulating protrusions 48 can be small in the process of connecting the two housings F, M.

Further, the lever-type connector includes the ring-shaped seal 15 for sealing between the outer periphery of the terminal accommodating portion 10 and the inner periphery of the receptacle 41 and the regulating protrusions 48 contact the outer peripheral surface of the terminal accommodating portion 10 with the two housings F, M connected, thereby exhibiting a positioning function of positioning the terminal accommodating portion 10 and the receptacle 41 in a radial direction. The regulating protrusions 48 have the positioning function according to this configuration. Thus, shape simplification is realized as compared with the case where a dedicated positioning means is provided separately from the regulating protrusions 48.

The invention is not limited to the above described embodiment. For example, the following embodiments are also included in the scope of the invention.

The regulating protrusions are ribs with a relatively small width in the above embodiment. However, the regulating protrusions may have a large width. Further, a formation range of the regulating protrusions in the width direction may be an area narrower than the entire width of the regulating wall or may be an area continuous over the entire width of the regulating wall.

Although the tip outer edge of the terminal accommodating portion is brought into contact with the regulating protrusions before the contact resistance between the female terminal fittings and the male terminal fittings is maximized in the above embodiment. However, the tip outer edge of the terminal accommodating portion may be brought into contact with the regulating protrusions after the contact resistance between the female terminal fittings and the male terminal fittings is maximized.

Male terminal fittings that differ in the positions of the projecting ends of the tabs projecting toward the female housing are provided in the above embodiment. However, the tips of the male terminal fittings may be aligned.

Although the regulating protrusions have the positioning function in the above embodiment, a dedicated positioning means may be provided separately from the regulating protrusions.

The male housing is mounted on the circuit board in the above embodiment. However, the male housing may be mounted on a wiring harness.

The long tabs proximately face the female terminal fittings when the tip outer edge of the terminal accommodating portion contacts the regulating protrusions in the above embodiment. However, the long tabs may contact the female terminal fittings when the tip outer edge of the terminal accommodating portion contacts the regulating protrusion.

LIST OF REFERENCE SIGNS

F . . . female housing
M . . . male housing
10 . . . terminal accommodating portion
10E . . . tip outer edge portion of terminal accommodating portion
12 . . . female terminal fitting
13 . . . tubular fitting portion
15 . . . seal member
16 . . . lever accommodating portion
20 . . . outer regulating portion portion
30 . . . lever
32 . . . cam groove
41 . . . receptacle
42L, 42S . . . male terminal fitting
43L, 43S . . . tab
44 . . . lower regulating wall
44E . . . tip outer edge of lower regulating wall
45 . . . facing wall portion
47 . . . cam follower
48 . . . regulating protrusion

What is claimed is:

1. A lever-type connector, comprising:

a female housing including a block-like terminal accommodating portion and a substantially rectangular tubular fitting surrounding the terminal accommodating portion;

a lever in the form of a single plate formed with a cam groove and rotatably accommodated in a lever accommodating portion of the tubular fitting;

a male housing including a substantially rectangular tubular receptacle;

a cam follower formed on an outer surface of the receptacle;

the female and male housings being set in an initial state when the receptacle is accommodated shallowly into a connection space between the terminal accommodating portion and the tubular fitting and the cam follower is inserted into an entrance of the cam groove, the female and male housings being connected by a cam action by engagement of the cam groove and the cam follower when the lever is rotated from the initial state, the tubular fitting having an outer regulating wall arranged on a side opposite to the lever accommodating portion across the terminal accommodating portion;

the receptacle having an inner regulating wall arranged along the outer regulating wall;

the receptacle further having a facing wall arranged along the lever accommodating portion and facing the inner regulating wall; and the inner regulating wall having an inner surface formed with at least one regulating protrusion;

wherein posture inclination between the female and male housings is regulated by contact of a tip outer edge of the inner regulating wall and an inner surface of the outer regulating wall and by contact of a tip outer edge of the terminal accommodating portion and the at least one regulating protrusion when an outer surface of the facing wall is not in contact with the lever accommodating portion in the process of rotating the lever.

2. The lever-type connector of claim 1, wherein the at least one regulating protrusion is in the form of at least one rib extending along a connecting direction of the female and male housings.

3. The lever-type connector of claim 1, wherein the tip outer edge of the terminal accommodating portion contacts the at least one regulating protrusion before contact resistance between a female terminal fitting in the female housing and a male terminal fitting in the male housing is maximized in the process of connecting the two housings.

4. The lever-type connector of claim 1, wherein:

a plurality of types of male terminal fittings are provided in the male housing and differ in positions of projecting ends of tabs projecting toward the female housing; and the tabs, the positions of whose projecting ends are close to the female housing, are in contact with or proximately face the female terminal fittings in the female housing and the tabs, the positions of whose projecting ends are distant from the female housing, are not in contact with the female terminal fittings in the female housing when the tip outer edge of the terminal accommodating portion contacts the regulating protrusion.

5. The lever-type connector of claim comprising a ring-shaped seal for sealing between an outer periphery of the terminal accommodating portion and an inner periphery of the receptacle, wherein:

the at least one regulating protrusion exhibits a positioning function of positioning the terminal accommodating portion and the receptacle in a radial direction by contacting an outer peripheral surface of the terminal accommodating portion when the female and male housings connected.

* * * * *